US006110416A

United States Patent [19]

Chapellier et al.

[11] Patent Number: 6,110,416

[45] Date of Patent: Aug. 29, 2000

[54] TUNDISH FOR CONTINUOUS CASTING OF METALS HAVING AT LEAST ONE PLASMA TORCH FOR REHEATING THE METAL

[75] Inventors: Philippe Chapellier, Thionville; Robert Grangier; Michel Henryon, both of Joudreville, all of France

[73] Assignee: Sollac, Puteaux, France

[21] Appl. No.: 09/058,202

[22] Filed: Apr. 10, 1998

[30] Foreign Application Priority Data

Apr. 23, 1997 [FR] France ..... 97 05014

[51] Int. Cl.[7] ..... C21B 7/00

[52] U.S. Cl. ..... 266/275; 266/280; 266/283

[58] Field of Search ..... 266/283, 275, 266/270, 280; 373/22; 110/182.5, 336

[56] References Cited

U.S. PATENT DOCUMENTS

| | | | |
|---|---|---|---|
| 4,416,621 | 11/1983 | Huther | 110/336 |
| 4,546,483 | 10/1985 | Lugscheider et al. | 373/22 |
| 4,686,687 | 8/1987 | Mure et al. . | |
| 5,088,423 | 2/1992 | Ogura et al. | 110/182.5 |
| 5,849,245 | 12/1998 | Egashira et al. | 266/275 |

FOREIGN PATENT DOCUMENTS

| | | |
|---|---|---|
| 0 453 188 | 10/1991 | European Pat. Off. . |
| 59-110741 | 6/1984 | Japan . |
| 3-138052 | 6/1991 | Japan . |
| 3-285745 | 12/1991 | Japan . |

*Primary Examiner*—Scott Kastler

*Attorney, Agent, or Firm*—Nixon Peabody LLP; Thomas W. Cole

[57] ABSTRACT

An annularly shaped piece (28) formed from refractory material is provided for a tundish (1) for continuous casting of metals for enclosing a plasma torch (18) for heating liquid metal (4). The interior wall (29) of the annularly shaped piece defines a space which widens with progression toward the bottom, the piece having an upper opening (30) and a lower opening and accommodating penetration of the lower end region of the torch (18) into the space. The annularly shaped piece (28) is fixed to a cover (24) or to the refractory walls (3) of the tundish (1), and/or is fixed to one or more dividing walls (10) which delimit a heating compartment (13) in the interior of said tundish (1), wherewith the space defined by the interior wall (29) of said piece (28) widens with progression toward the bottom of the tundish (1). The annularly shaped piece (28) provides a more durable enclosure for the plasma torch (18), and enhances the torch's efficiency by better focusing the torch radiation onto molten metal in the tundish (1).

5 Claims, 3 Drawing Sheets

Fig. 1 (art antérieur)

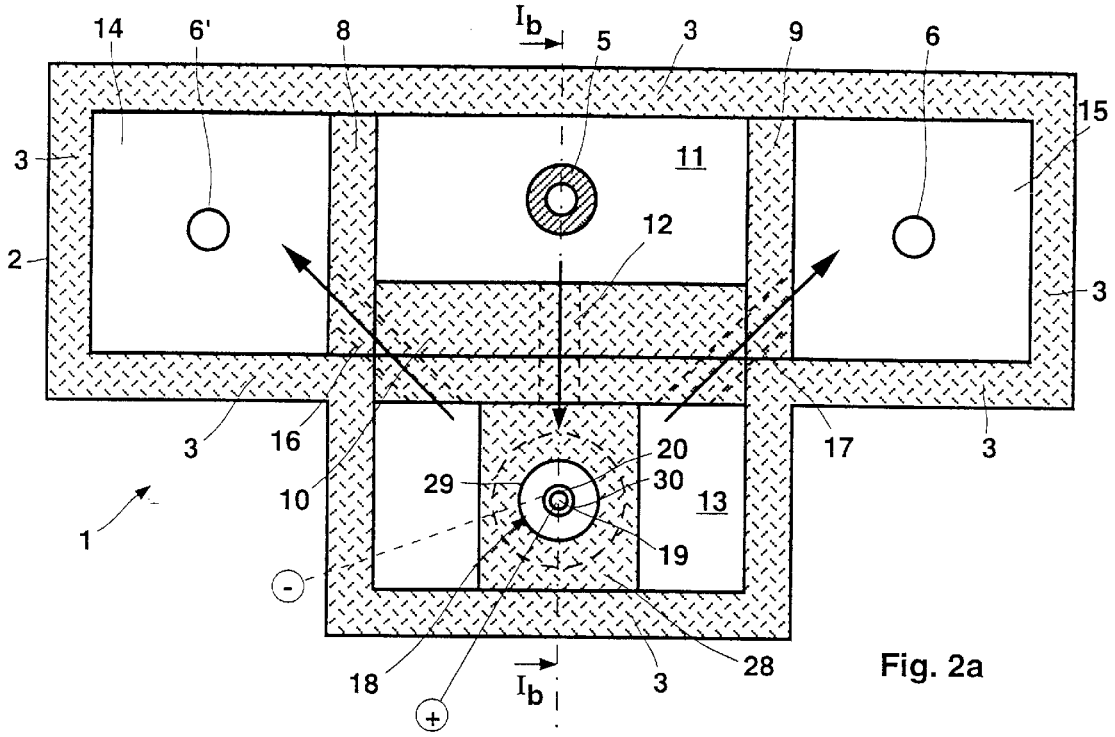
Fig. 2a
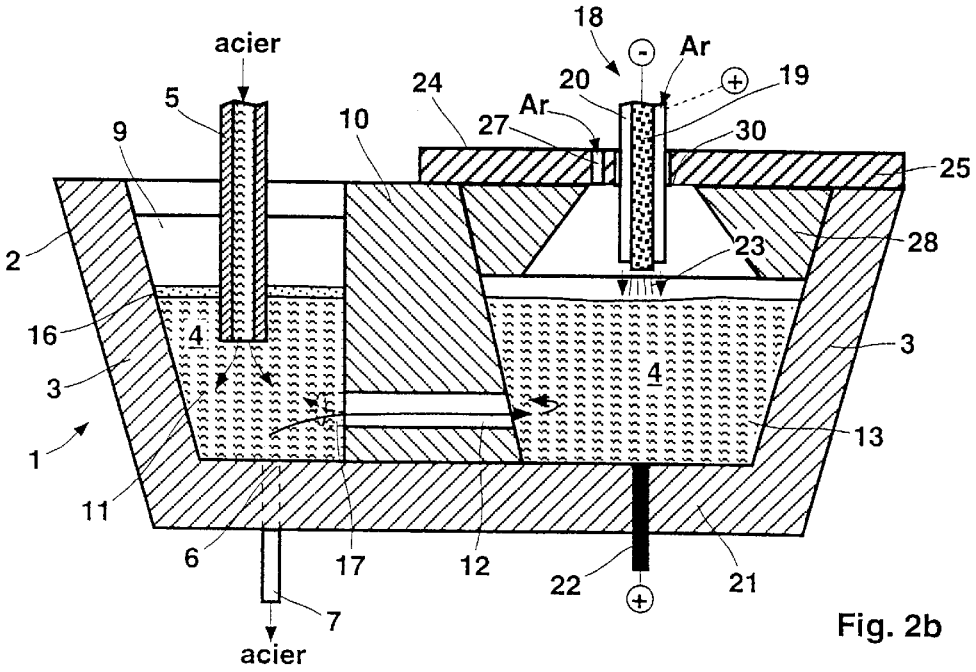
Fig. 2b
Fig. 2

TUNDISH FOR CONTINUOUS CASTING OF METALS HAVING AT LEAST ONE PLASMA TORCH FOR REHEATING THE METAL

BACKGROUND OF THE INVENTION

The invention relates to the casting of metals, e.g. steel. In particular, the invention relates to continuous casting machines having a plasma torch for heating the metal as the metal is passed from place to place in the tundish.

In a continuous casting system, the liquid steel contained in the casting ladle where its composition is adjusted is not directly teemed into the bottomless mold having cooled walls, in which molds solidification is initiated and carried out. Rather, the metal is first passed into a container designated a tundish (or distributing container) which has a refractory interior lining. The tundish has a number of functions. Firstly, one or more openings, called tundish nozzles, are provided in the bottom of the tundish. Each such opening is disposed over a respective mold. In this way, liquid metal can be distributed to a plurality of molds even though the casting ladle has only one outlet opening for the metal. Secondly, the tundish serves as a reservoir of liquid metal which allows casting of the metal to continue after the ladle is emptied, during the time the empty ladle is being moved away and replaced by a new ladle and the teeming of metal from the new ladle is begun. In this way, continuous casting can be conducted without interruption using the contents of a whole series of successive ladles, which process is called "sequential continuous casting". Finally, the tundish advantageously serves as a container for the decantation of undesirable non-metallic inclusions present in the liquid steel; the higher the mean residence time of the metal the more important such a capability is.

In certain continuous casting facilities it is possible to affect the temperature of the liquid steel by means of a heating device. This capability affords certain advantages:

One can reduce the range of variability of the temperature of the steel leaving the tundish during a casting operation. Generally the time to empty a single ladle is on the order of tens of minutes, during which time the temperature of the liquid steel contained in the ladle may drop by tens of degrees centigrade. Particularly near the end of the casting of a given heat, the ability to add energy to the contents of the tundish allow one to compensate at least partially for such temperature decreases. By such appropriate such heating one can limit variations of the temperature of the metal leaving the tundish to a range of only several degrees over the entire casting operation.

The temperature of the metal in the earlier refining stages can be reduced, with resulting gains in the productivity and economic efficiency of the steelworks. E.g., the heating times for the metal during converter treatment, and/or in an electric furnace or furnace-ladle, can be decreased, and savings can be achieved by the reduced erosion of refractory materials lining the various metallurgical vessels.

In general, this tighter control of the temperature makes it easier to obtain a temperature of the steel in the tundish which is relatively close to the liquidus temperature of the alloy being cast. The difference between the two temperatures is called the "superheat".

From a metallurgical standpoint, a low superheat favors the production of a solidified product which has a low degree of segregation of alloying elements over the cross section of the product—such elements as carbon, manganese, and sulfur; accordingly, such a product has good homogeneity of mechanical properties. Such homogeneity is particularly important in casting of high alloy steels. Further, a low superheat allows a short solidification time for the product, and thereby a higher speed of casting, resulting in improved productivity of the steelworks; it also allows one to devise a continuous casting machine of more compact dimensions, resulting in savings in invested capital.

A first means of supplying thermal energy to metal passing through the tundish is to pass at least part of the metal through a channel surrounded by an inductor having suitable characteristics, wherewith the currents induced in the metal will cause heating by the Joule effect. Such a technique is costly, and the substantial space required by the inductor system makes the technique difficult to employ in installations of small dimensions or installations not originally designed for use with induction heating.

Another heating means consists of mounting one or more plasma torches above the liquid metal in the tundish. PCT application WO 95/32069 describes a tundish thus equipped. The reader will recall that a plasma torch operates essentially by introducing a pressurized gas (a plasmagenic gas, such as nitrogen or argon) above the material to be heated. This gas is caused to pass over an arc generated between a cathode and an anode, whereby the gas is partially ionized and is brought to a very high temperature (4,000 to 15,000 K). The hot gas has a high thermal conductivity and high radiative power, rendering it capable of transferring heat rapidly and intensely to the material to be heated. By varying the pressure of the gas and the intensity of the current, one can easily achieve the power levels needed to obtain the desired heating of the steel in the tundish, namely several hundred kW. At the same time, suitable plasma torches are small enough to be used in tundishes of relatively compact size.

Two different types of plasma torches may be used in the described application. The first type, the "propelled plasma" torch, has both cathode and anode built into the torch. In the second type, the "transferred plasma" torch, only the cathode is built into the torch. The anode is comprised of the liquid metal to be heated, and an electrically conducting element is provided in the bottom of the tundish, which conducting element contacts the liquid metal during the casting operation and is connected to the positive terminal of the electric power supply of the torch. Alternatively, in a "transferred plasma" torch, the anode may be built into the torch and the cathode may be provided in the bottom of the tundish.

The zone of the tundish in which the torch is mounted should be enclosed by a cover having a refractory interior lining. This cover prevents exposing personnel walking in the vicinity of the apparatus to the intensely bright radiation from the arc. Further, the liquid metal under the torch, upon which the torch acts, must be bare, and in particular cannot be covered by the thermally insulating powder which is customarily spread over the liquid metal surface so as to protect the liquid metal from oxidation by the atmosphere and to stop radiation emitted by the liquid metal. In addition to the plasmagenic gas, one may introduce an inert gas such as argon under the cover (or during periods when the torch is not being used one may introduce the inert gas instead of the plasmagenic gas). This allows the atmosphere in the neighborhood of the torch to be kept practically free of oxygen which could otherwise tend to cause contamination of the liquid metal.

A substantial amount of the radiation from the arc emitted by the torch impinges on the refractory materials which line the tundish and the cover of the tundish. Consequently, said refractory materials are brought to a very high surface temperature which may exceed 1800° C. when the torch is operated at high power. At such temperatures, magnesia and alumina, which are the refractory materials customarily used, approach their fusion points; the linings deteriorate rapidly, and require frequent replacement, particularly the lining of the cover. Moreover, refractory material which has been fused tends to flow or drip onto the surface of the metal bath, where it forms an insulating crust which impedes heat transfer between the plasma and the metal and which eventually may cause the arc to be extinguished in the case of a "transferred plasma" torch. Fused refractory material may also flow or drip from the cover onto the metal sheath surrounding the torch, damaging the sheath. Consequently, it becomes necessary to find an operating regime of the torch which is a compromise between insufficient heating of the metal and excessive deterioration of the refractories; such a regime (if it exists) comes at a cost to the optimum efficiency theoretically available with the use of a plasma torch.

One way to solve the problem is to line the tundish and cover with a refractory material having a higher fusion temperature than materials customarily used; e.g. one might use silicon carbide or a ceramic. However, regardless of the lining material used it is necessary to replace the tundish lining after every casting operation or sequence of casting operations. The use of a higher grade refractory will thus substantially increase the operating costs of the apparatus, canceling out most of the economic advantage of using a plasma torch.

The object of the present invention was to devise economical means of limiting the deterioration of the refractory lining of a tundish and tundish cover in the zone of action of a plasma torch, without compromising the energy efficiency and economic efficiency of using a plasma torch for heating the metal.

SUMMARY OF THE INVENTION

The principal claimed matter of the invention is an annularly shaped piece of refractory material, intended to be installed in a tundish for continuous casting of metals, in conjunction with at least one plasma torch for heating liquid metal, wherewith the interior wall of said annularly shaped piece defines a space which widens with progression toward the bottom, said piece having an upper opening and a lower opening and accommodating penetration of the lower end region of said torch into said space.

Additional claimed matter of the invention is a tundish for continuous casting of metals, of a type comprised of at least one plasma torch for heating liquid metal, and at least one cover through which (each respective) torch throughgoingly extends;

characterized in that said tundish has an annularly shaped piece comprised of refractory material, which piece is of the type described above, wherewith said piece is fixed to said cover or to the refractory walls of said tundish, and/or is fixed to one or more dividing walls which delimit a heating compartment in the interior of said tundish, wherewith the space defined by the interior wall of said piece widens with progression toward the bottom of the tundish.

As seen, the invention essentially consists of fixing an annularly shaped piece comprised of refractory material to the tundish or to a cover of the tundish, such that the interior wall of said annularly shaped piece surrounds the end region of the plasma torch, and said wall redirects the radiation incident upon it to a direction generally toward the metal. Said annularly shaped piece protects the linings of the tundish and cover, and as such said piece may be unique among the components of the tundish in being fabricated from a material having particularly high stability with respect to the radiation from the arc. The engineering design of the annularly shaped piece may be such that it is used for a single casting operation or series of casting operations and is replaced each time the lining of the tundish is replaced. Alternatively, particularly if the annularly shaped piece is comprised of ceramic material, said piece may be reusable, such that it may be used for a plurality of casting operations or a plurality of series of casting operations.

Another noteworthy advantage of the described annularly shaped piece is that the radiation impinging on it from the arc is reflected by said piece toward the liquid metal, which raises the heating efficiency of the plasma torch, namely by increasing the proportion of the radiation which effectively engages the metal.

BRIEF DESCRIPTION OF THE DRAWINGS

The invention will be better understood with the aid of the following description, with reference to the accompanying drawings.

FIGS. 2*a* and 2*b* are schematic views—a plan view and a transverse cross-sectional profile view through line Ib—Ib, respectively—of a tundish for continuous casting of steel, according to the invention.

DETAILED DESCRIPTION OF THE PREFERRED EMBODIMENT

Figure 1A:
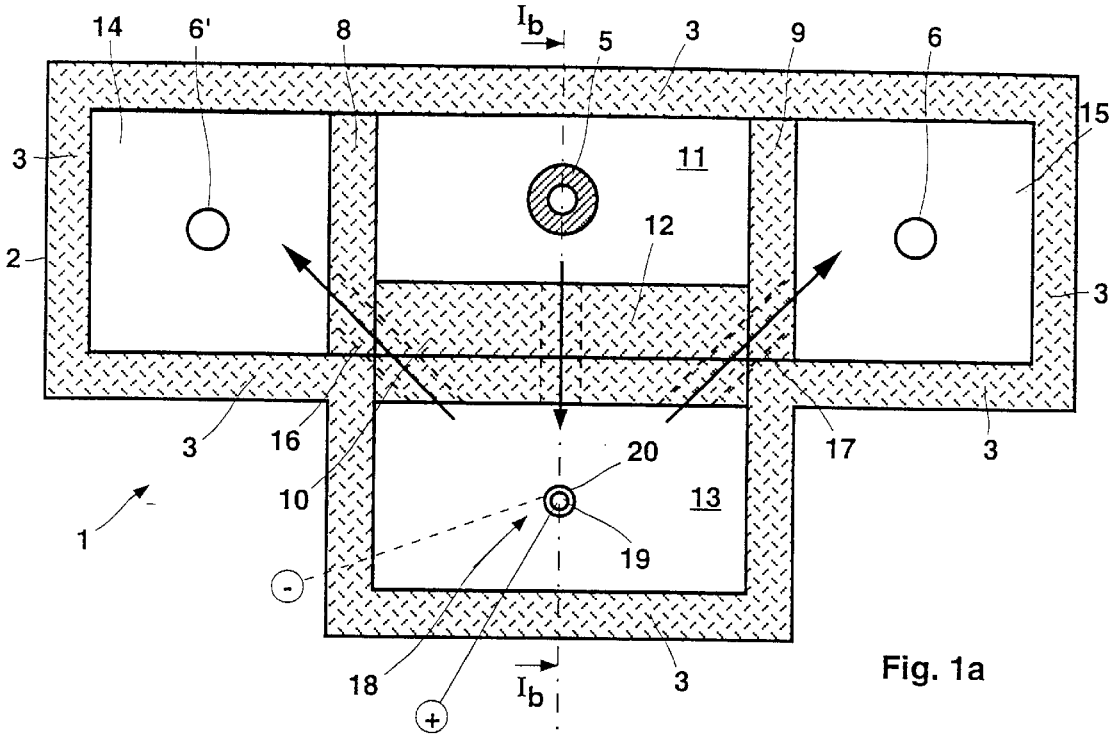
FIGS. 1*a* and 1*b* are schematic views—a plan view and a transverse cross-sectional profile view through line Ib—Ib, respectively—of a tundish for continuous casting of steel, according to the prior art.
Figure 1B:
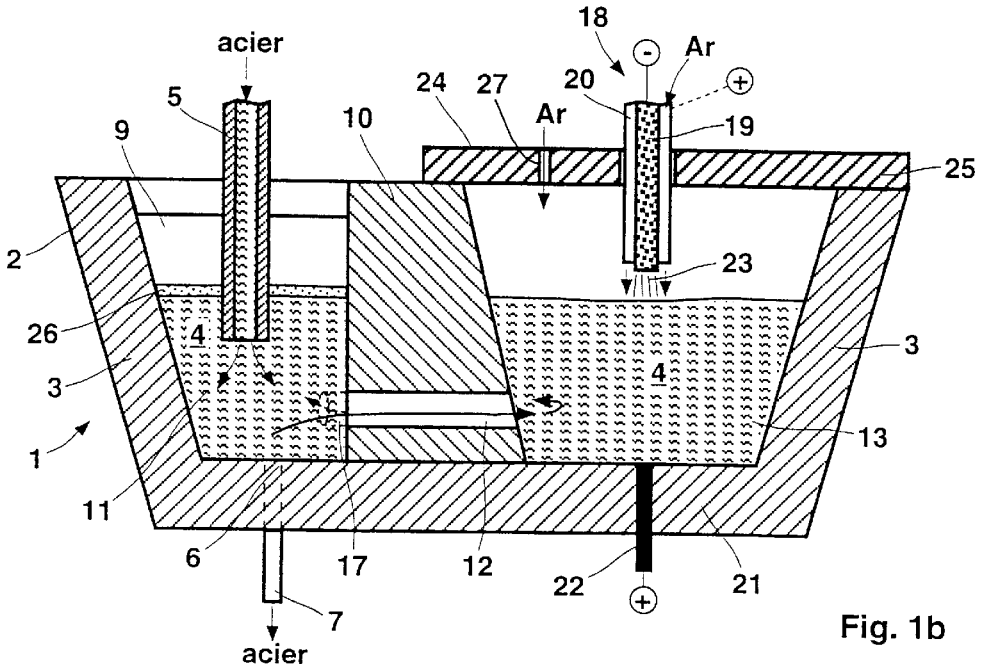

FIGS. 1*a* and 1*b* illustrate a tundish 1 for continuous casting of steel, according to the prior art. In the example shown of this prior art device, which is not limitative with respect to the scope of the invention, the tundish allows one to supply molten steel to a continuous casting machine (not shown) which has two molds. The tundish has an exterior metal shell 2 which is lined interiorly by a refractory 3. The interior space of tundish 1 has a shape which widens with progression upward, so that after the casting the lining 3 can be removed easily by inverting the tundish 1. The liquid steel 4 (not shown in FIG. 1*a*) is supplied to the tundish 1 from a ladle (not shown), via a refractory tube (so-called "shroud") 5 connected to the outlet opening of the ladle. This tube 5 protects the liquid metal 4 against oxidation by the atmosphere. The liquid steel 4 flows out into the molds (not shown) via openings (tundish nozzles) (6, 6'). Refractory tubes or shrouds 7 connected to the nozzles (6, 6') protect the liquid steel against oxidation by the atmosphere as it passes from the tundish 1 to the molds corresponding to the respective tundish nozzles (6, 6').

The tundish 1 illustrated as representative of the prior art has a generally rectangular shape. Refractory walls (8, 9, 10) divide the interior of tundish 1 into four compartments. Two of the dividing walls (8, 9) are perpendicular to the long sides of the tundish 1, whereas dividing wall 10 is parallel to said long sides and extends between dividing walls 8 and 9. The three dividing walls (8, 9, 10) delimit a first compartment 11, in which the liquid metal is received from the tube 5 connected to the ladle. The liquid steel 4 then passes through a throughgoing conduit 12 in wall 10, leading to a second compartment 13 which, in the example shown, is in the form of a laterally projecting structure on the tundish 1 disposed apposite to the feed tube 5 for the liquid metal 4. As seen, the liquid steel is re-heated (or further heated) in said second compartment 13, after which it is passed into the third and fourth compartments (14, 15), respectively, via respective conduits (16, 17) extending through the walls (10, 8; 10, 9). The tundish nozzles (6, 6) which are disposed above the molds of the continuous casting machine are located in said third and fourth compartments (14, 15).

The heating device for the liquid steel 4 is comprised of a plasma torch 18 (shown only schematically) of a type which is per se known. Torch 18 is comprised of a cathode 19 comprised of a material such as a thorium tungsten alloy, connected to the negative terminal of the electric power source for the torch. Cathode 19 is surrounded by a metal sheath 20, comprised of, e.g., copper, which may serve as the anode. If the torch 19 is of the transferred plasma type, as in the embodiment illustrated, the metal sheath 20 acts as an anode only at the time of triggering of the arc. If torch 19 is of the propelled plasma type, sheath 20 will be continuously connected to the positive terminal of the electric power source for the torch. The plasmagenic gas is introduced between sheath 20 and cathode 19. Said gas may be argon; or may be nitrogen if the grade of steel which is being cast will tolerate a relatively high nitrogen content. An anode 22, which may comprise a steel bar cooled over at least part of its length, is implanted in the bottom 21 of the tundish 1. Anode 22 is also connected to the positive terminal of the electric power source for the torch. This arrangement produces an electric arc 23 between the cathode 19 and the liquid metal 4 which is in contact with the bottom anode 22. The plasmagenic gas passes into said arc in such a way as to heat the liquid steel 4 present in the second compartment 13, which compartment is designated the "heating compartment".

A cover 24 (not shown in FIG. 1*a*) must be provided for heating compartment 13. The torch 18 extends throughgoingly through said cover. Interiorly, cover 24 has a refractory lining 25, to protect personnel walking near the casting machine from the intense light of the plasma. Cover 24 also makes it possible to confine the atmosphere in proximity to the heating compartment 13 and exclude the ambient atmosphere, wherewith the argon expelled by the torch 18 is maintained in the space above the liquid metal 4, so as to suppress oxidation by the atmosphere which would otherwise occur. The oxidation susceptibility is increased in the heating compartment 13 because the practice of covering the surface of the liquid metal 4 with an insulating powder, which would obstruct the thermal and electrical transfer processes between the torch 18 and the metal 4, is not possible. Such a powder 26 is provided on the surface of the liquid metal 4 in the other compartments (11, 14, 15) of the tundish. During the periods when the torch 18 is not in operation, protection may be maintained in compartment 13 by injecting additional argon into the space below the cover 24 via an opening 27.

As mentioned, in the described tundish the radiation (broadly defined) of the electric arc 23 causes rapid attrition of the refractory lining 3 of the tundish 1 in the heating compartment 13, and rapid attrition of the dividing wall 10 and the refractory lining 25 of the cover 24. These effects may at times extend to fusion of the surface of said materials, accompanied by all of the problems described above in connection with such fusion. Accordingly, the materials chosen for refractories exposed to the effects of the arc 23 must have high resistance to the arc radiation, which entails substantial additional cost.

The inventive tundish illustrated in FIGS. 2*a* and 2*b* is an improvement of the above-described known tundish. In FIGS. 2*a* and 2*b*, components corresponding to those in FIGS. 1*a* and 1*b* are designated with like reference numerals. The inventive tundish solves the above-identified problems. For this purpose, an annular piece 28 comprised of a refractory material having high resistance to the radiation (broadly defined) of the electric arc 23 is disposed in the heating compartment 13 of the tundish 1. In the embodiment shown, the annular piece 28 is supported on the refractory lining 3 of the shell of tundish 1, and on the dividing wall 10 which separates the heating compartment 13 from the compartment 11 of tundish 1 which compartment 11 receives the liquid steel 4. Optionally, annular piece 28 may be fixed to the lining 25 of the cover 24. The interior wall 29 of the annular piece 28 has an inverted frustro conical shape, with the interior conical surface facing at an angle toward the surface of the liquid metal 4. The placement and dimensions of the annular piece 28 are such that when the plasma torch 18 is in service the lower end of the torch is disposed below the upper opening 30 of piece 28, preferably by a substantial distance. In this way, the part of the radiation of the electric arc 23 which otherwise would impinge on the dividing wall 10 and the refractories (3, 25) which line the heating compartment 13 and the cover 24 is almost entirely intercepted by the interior wall 29 of the annular piece 28 and is redirected toward the liquid metal 4 present in the heating compartment 13. Consequently, the service life of the refractory lining 25 of the cover 24 is substantially prolonged; and attrition of the refractory lining 3 of the shell walls of the tundish, as well as attrition of the surface of the dividing wall 10 in the heating compartment 13, which attrition tends to occur during the casting, is impeded. The service life of the lining 25 of the cover 24 can be increased thereby from 20–30 hr to more than 100 hr. Piece 28 may be comprised of tabular alumina. Under the same conditions it was found that for a given operating power consumption of the torch (c. 300 W) the temperature of the liquid steel 4 in the heating compartment 13 can be increased by 14° C., compared to an increase of only 10° C. if annular piece 28 is not used. This improvement is attributed to:

- the decrease in deterioration of the refractories, which leads to reduced formation of a crust on the surface of the liquid metal 4, and
- the shape of the annular piece 28, which redirects radiation of the arc, namely that part of the radiation which would otherwise impinge on the lining 25 of cover 24 and the lining 3 of the shell of the tundish 1 and would not reach the liquid metal 4 until it had been attenuated by multiple reflections.

The material of which annular piece 28 is comprised is a refractory mass which can resist the radiation of the arc 23 during the entire utilization of the tundish 1 and its shell lining 3, which utilization may comprise casting of the contents of a single ladle or casting of contents from a sequence of ladles. Candidate materials for such use include tabular alumina, alumina spinel, and silicon carbide. When the annular piece 28 is used it is no longer necessary to provide such more robust refractories on the linings of the entirety of the heating compartment 13 and cover 24 of tundish 1; accordingly, the total cost of refractories for the apparatus is reduced. Moreover, if the material used has a particularly high resistance to the radiation, e.g. is a material such as a ceramic with fusion temperature on the order of 2000° C., it may be possible to re-use the annular piece 28 after it is separated from the spent lining of the tundish. Ceramics also afford the advantage of excellent reflectivity of the radiation of the arc 23, thereby improving the thermal efficiency of the apparatus.

The actual interior and exterior shape of the annular piece 28 may vary from that shown in FIG. 2, which is merely one example. E.g., the interior space of piece 28 may have the shape of a truncated pyramid rather than a truncated cone. Similarly, the external shape of piece 28 may be adapted to the geometry of the heating compartment 13 of the tundish 1.

Figure 3:
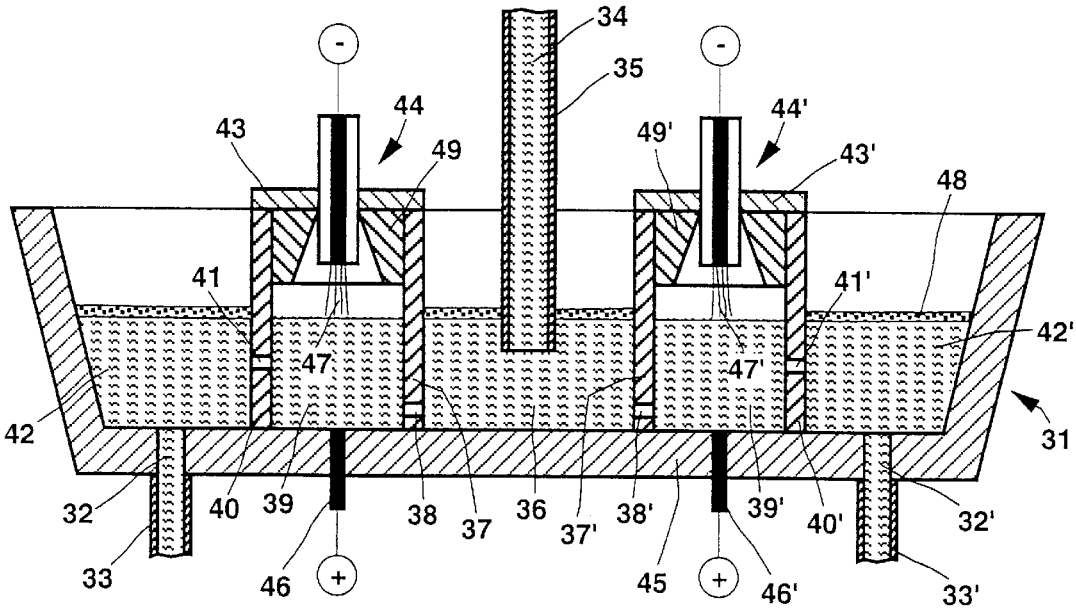
FIG. 3 is a schematic longitudinal cross sectional profile of a variant embodiment of the inventive tundish.

The inventive tundish shown in FIG. 3 is an example of adaption of the invention to a tundish 31 having an overall shape of the plan view which is generally rectangular (having four sides). With this arrangement, due to geometric considerations it is not possible to provide a single heating compartment through which all of the molten metal passes, as was provided in the examples of FIGS. 1 and 2. As with those examples, the tundish of FIG. 3 has two openings (tundish nozzles) (32, 32') each of which has an extension in the form of a refractory tube (shroud) (33, 33') which extends into a mold (not shown). Liquid steel 34 is supplied to tundish 31 via a refractory tube (shroud) 35 the upper end of which is connected to a ladle (not shown). The liquid steel 34 flows out of the tube 35 into a central compartment 36 defined by a first pair of refractory dividing walls (37, 37') extending over the entire width of the tundish 31 and disposed on respective sides of the tube 35. Perforations (38, 38') are provided in these first dividing walls (37, 37'), which perforations allow liquid steel 34 to pass into two heating compartments (39, 39') which adjoin the central compartment 36. The heating compartments (39, 39') are each delimited by one of the first dividing walls (37, 37') and one of a second pair of refractory dividing walls (40, 40'). Perforations (41, 41') are provided in these second dividing walls (40, 40'), allowing the liquid steel to pass into the discharge compartments (42, 42') where the discharge openings (tundish wells) (32, 32') are disposed. Each heating compartment (39, 39') is covered by a respective cover (43, 43') which is lined with refractory material. A respective plasma torch (44, 44'), similar to that described above, extends throughgoingly through each of said covers. Where, as in the embodiment illustrated, the torches are of the transferred plasma type, anodes (46, 46'), similar to those described supra, transversely penetrate the bottom 45 of the tundish 31 into the heating compartments (39, 39'). This arrangement allows electric arcs (47, 47') to be produced between the torches (44, 44') and the liquid steel 34 in the heating compartments (39, 39'), in coordination with the plasmagenic gas introduced via the torches (44, 44'), which arcs heat the liquid metal 34. The liquid metal 34 in the tundish is covered by a layer of protective powder 48 at locations other than in the heating compartments (39, 39'); if used in the heating compartments it would impede the functioning of the torches (44, 44'). In this connection, the positions of the various perforations (38, 38'; 41, 41') in the dividing walls (37, 37'; 40, 40') are selected such that the protective powder 48 will not be carried into the heating compartments (39, 39') during the casting.

According to the invention, annular pieces (49, 49') (FIG. 3) which are similar in function and design to the annular piece 28 described above and illustrated in FIG. 2, are provided in addition to the refractory elements defining the heating compartments (39, 39'). Likewise, the interior space of each annular piece has an inverted frustro conical shape, with the interior conical surface facing at an angle toward the surface of the liquid metal 34 present in the respective heating compartment (39, 39'). In the example illustrated, the annular pieces (49, 49') are fixed to the dividing walls (37, 40; 37', 40') which delimit the heating compartments (39, 39'); however, optionally they may be fixed only to the refractory lining of the tundish 31, or only to the covers (43, 43').

It goes without saying that the particular embodiments of inventive tundishes described and illustrated are presented merely as examples, which may be readily adapted to other types of tundishes for continuous casting of steel or other metals. E.g., it is not essential that a tundish have one or more heating compartments which are clearly delimited by one or more dividing walls. It suffices for the concept according to the invention if the part of the radiation of the arc generated by the plasma torch which would customarily impinge on:

the cover through which the given torch throughgoingly extends and the lateral walls of the tundish is intercepted by the internal wall of the annular piece and is deflected (redirected) toward the metal, i.e. generally toward the bottom of the tundish. In the absence of the described dividing walls, the annular piece(s) must be fixed to the refractory walls of the tundish, or to the cover(s).

What is claimed:

1. A tundish for continuous casting of metals, comprising:

inside tundish walls formed from a refractory material;

at least one plasma torch for heating liquid metal, at least one cover through which said torch extends, and an insert including refractory material and having an outside wall complementary in shape to an upper portion of said inside walls of said tundish, and an interior wall that defines a space which progressively widens toward a bottom thereof, said insert having a means for accommodating in said space a lower end region of said torch for heating liquid metal with a plasma including an upper and a lower opening in said insert, wherein said interior wall has a heat reflective surface that is lower than said tundish cover for reflecting heat generated by said plasma toward liquid metal in said tundish, the insert being fixed to one of said tundish cover and said inside tundish walls, and a dividing wall which delimits a heating compartment in an interior of said tundish.

2. The tundish according to claim 1, wherein said space defined by said interior wall of said insert has a frustro conical shape.

3. The tundish according to claim 1, wherein said space defined by said interior wall of said insert has a truncated pyramidal shape.

4. The tundish according to claim 1 wherein said insert includes alumina.

5. The tundish according to claim 1 wherein said insert includes silicon carbide.

* * * * *